US007577527B2

(12) United States Patent
Vega Velasquez

(10) Patent No.: US 7,577,527 B2
(45) Date of Patent: Aug. 18, 2009

(54) BAYESIAN PRODUCTION ANALYSIS TECHNIQUE FOR MULTISTAGE FRACTURE WELLS

(75) Inventor: Leonardo Vega Velasquez, Greenwood Village, CO (US)

(73) Assignee: Schlumberger Technology Corporation, Houston, TX (US)

( * ) Notice: Subject to any disclaimer, the term of this patent is extended or adjusted under 35 U.S.C. 154(b) by 13 days.

(21) Appl. No.: 11/648,035

(22) Filed: Dec. 29, 2006

(65) Prior Publication Data

US 2008/0162099 A1 Jul. 3, 2008

(51) Int. Cl.
*G01V 1/40* (2006.01)

(52) U.S. Cl. ..... 702/6

(58) Field of Classification Search ..... 702/6
See application file for complete search history.

(56) References Cited

U.S. PATENT DOCUMENTS

| | | | | |
|---|---|---|---|---|
| 5,404,010 | A * | 4/1995 | Anderson et al. | 250/260 |
| 5,992,519 | A | 11/1999 | Ramakrishnan et al. | |
| 6,178,815 | B1 | 1/2001 | Felling et al. | |
| 6,182,013 | B1 * | 1/2001 | Malinverno et al. | 702/7 |
| 6,775,578 | B2 | 8/2004 | Couet et al. | |
| 6,980,940 | B1 | 12/2005 | Gurpinar et al. | |
| 7,363,159 | B2 * | 4/2008 | Haugland | 702/7 |
| 2002/0043370 | A1 | 4/2002 | Poe | |
| 2005/0192855 | A1 * | 9/2005 | Chitty et al. | 705/7 |

FOREIGN PATENT DOCUMENTS

WO 2004049216 6/2004

OTHER PUBLICATIONS

Spivey, J.P.: Estimating Layer Properties for Wells in Multilayer Low-Permeability Gas Reservoirs by Automatic History-Matching Production and Production Log Data, paper SPE100509 presented at the 2006 SPE Gas Technology Symposium held in Calgary, Alberta, Canada, May 15-17, 2006.

Cinco-Ley, H. and Samaniego-V, F.: "Transient Pressure Analysis for Fractured Wells," Journal of Petroleum Technology, Sep. 1, 1981, 17 pages.

International Search Report dated Jun. 2, 2008 (3 pages).

* cited by examiner

*Primary Examiner*—Bryan Bui
*Assistant Examiner*—Jonathan Teixeira Moffat
(74) *Attorney, Agent, or Firm*—Robert P. Lord

(57) ABSTRACT

A method for characterizing a fractured wellbore involves obtaining static data and production data from the fractured wellbore, integrating the static data and the production data using Bayes's theorem, and calculating a plurality of model parameters from Bayes's theorem, where the plurality of model parameters is used to alter completion of the fractured wellbore.

25 Claims, 6 Drawing Sheets

BAYESIAN PRODUCTION ANALYSIS TECHNIQUE FOR MULTISTAGE FRACTURE WELLS

BACKGROUND

Oilfield activities involve various sub-activities used to locate and gather valuable hydrocarbons. Various tools, such as seismic tools, are often used to locate the hydrocarbons. One or more drilling operations may be positioned across an oilfield to locate and/or gather the hydrocarbons from subterranean reservoirs of an oilfield. The drilling operations are provided with tools capable of advancing into the ground and removing hydrocarbons from the subterranean reservoirs. Once the drilling operation is complete, production facilities are positioned at surface locations to collect the hydrocarbons from the wellsite(s). Fluid is drawn from the subterranean reservoir(s) and passed to the production facilities via transport mechanisms, such as tubing. Various equipment is positioned about the oilfield to monitor and manipulate the flow of hydrocarbons from the reservoir(s).

During oilfield activities, it is often desirable to monitor various oilfield parameters, such as fluid flow rates, flow pressures, etc. Sensors may be positioned about the oilfield to collect data relating to the wellsite and the processing facility, among others. For example, sensors in the wellbore may monitor flow pressure, sensors located along the flow path may monitor flow rates, and sensors at the processing facility may monitor fluids collected. The monitored data is often used to make real-time decisions at the oilfield. Data collected by these sensors may be further analyzed and processed.

The processed data may be used to determine conditions at the wellsite(s) and/or other portions of the oilfield, and to make decisions concerning these activities. Operating parameters, such as wellsite setup, drilling trajectories, flow rates, wellbore pressures, and other parameters, may be adjusted based on the received information. In some cases, known patterns of behavior of various oilfield configurations, geological factors, operating conditions or other parameters may be collected over time to predict future oilfield activities.

Oilfield data are often used to monitor and/or perform various oilfield activities. Numerous factors may be considered in operating an oilfield. Thus, the analysis of large quantities of a wide variety of data is often complex. Over the years, oilfield applications have been developed to assist in processing data. For example, simulators, or other scientific applications, have been developed to take large amounts of oilfield data and to model various oilfield activities. Typically, there are different types of simulators for different purposes. Examples of these simulators are described in patent/application Nos. U.S. Pat. No. 5,992,519, WO2004049216, and U.S. Pat. No. 6,980,940.

Numerous oilfield activities, such as drilling, evaluating, completing, monitoring, producing, simulating, reporting, etc., may be performed. Typically, each oilfield activity is performed and controlled separately using separate oilfield applications that are each written for a single purpose. Thus, many such activities are often performed using separate oilfield applications. In some cases, it may be necessary to develop special applications, or modify existing applications to provide the necessary functionality.

For instance, fractures are often induced hydraulically in low-permeability reservoirs to boost hydrocarbon flow. To fracture the rock, a fluid is injected into the rock at a high pressure. Proppant, such as sand of a particular size, is then injected into the fracture to keep it open and enhance hydrocarbon flow into the wellbore. Hydraulic fracturing is sometimes performed on very thick pays. As a result, fractures are induced in stages along the length of a wellbore, creating multiple reservoir zones along the wellbore. Data from the fractured wellbore is then collected and analyzed by an oilfield application to characterize the various reservoirs and completions.

Wells with very different fracture and reservoir characteristics may display very similar performances. This is known as non-uniqueness. Current production analysis techniques for single fracture wells may be used to analyze multilayer wells. However, the results give only the effective properties of an equivalent single-layer reservoir. Consequently, a method that can be used to make decisions regarding stimulation effectiveness for individual layers of a multilayer reservoir is needed.

SUMMARY

In general, in one aspect, the invention relates to a method for characterizing a fractured wellbore. The method comprises obtaining static data and production data from the fractured wellbore, integrating the static data and the production data using Bayes's theorem, and calculating a plurality of model parameters from Bayes's theorem, wherein the plurality of model parameters is used to alter completion of the fractured wellbore.

In general, in one aspect, the invention relates to a system for characterizing a fractured wellbore. The system comprises a static module, wherein the static analysis module is configured to obtain static data from the fractured wellbore, a dynamic module, wherein the dynamic analysis module is configured to obtain production data from the fractured wellbore, and a parameter estimator configured to: integrate the static and production data using Bayes's theorem, and calculate a plurality of model parameters from Bayes's theorem, wherein the plurality of model parameters is used to alter completion of the fractured wellbore.

In general, in one aspect, the invention relates to a computer system for managing an oilfield activity for an oilfield having at least one processing facility and at least one wellsite operatively connected thereto, each at least one wellsite having a fractured wellbore penetrating a subterranean formation for extracting fluid from an underground reservoir therein. The computer system comprises a processor, memory, and software instructions stored in memory to execute on the processor to: obtain static data and production data from the fractured wellbore, integrate the static data and the production data using Bayes's theorem, and calculate a plurality of model parameters from Bayes's theorem, wherein the plurality of model parameters is used to alter completion of the fractured wellbore.

Other aspects of the invention will be apparent from the following description and the appended claims.

DETAILED DESCRIPTION

Figure 1:
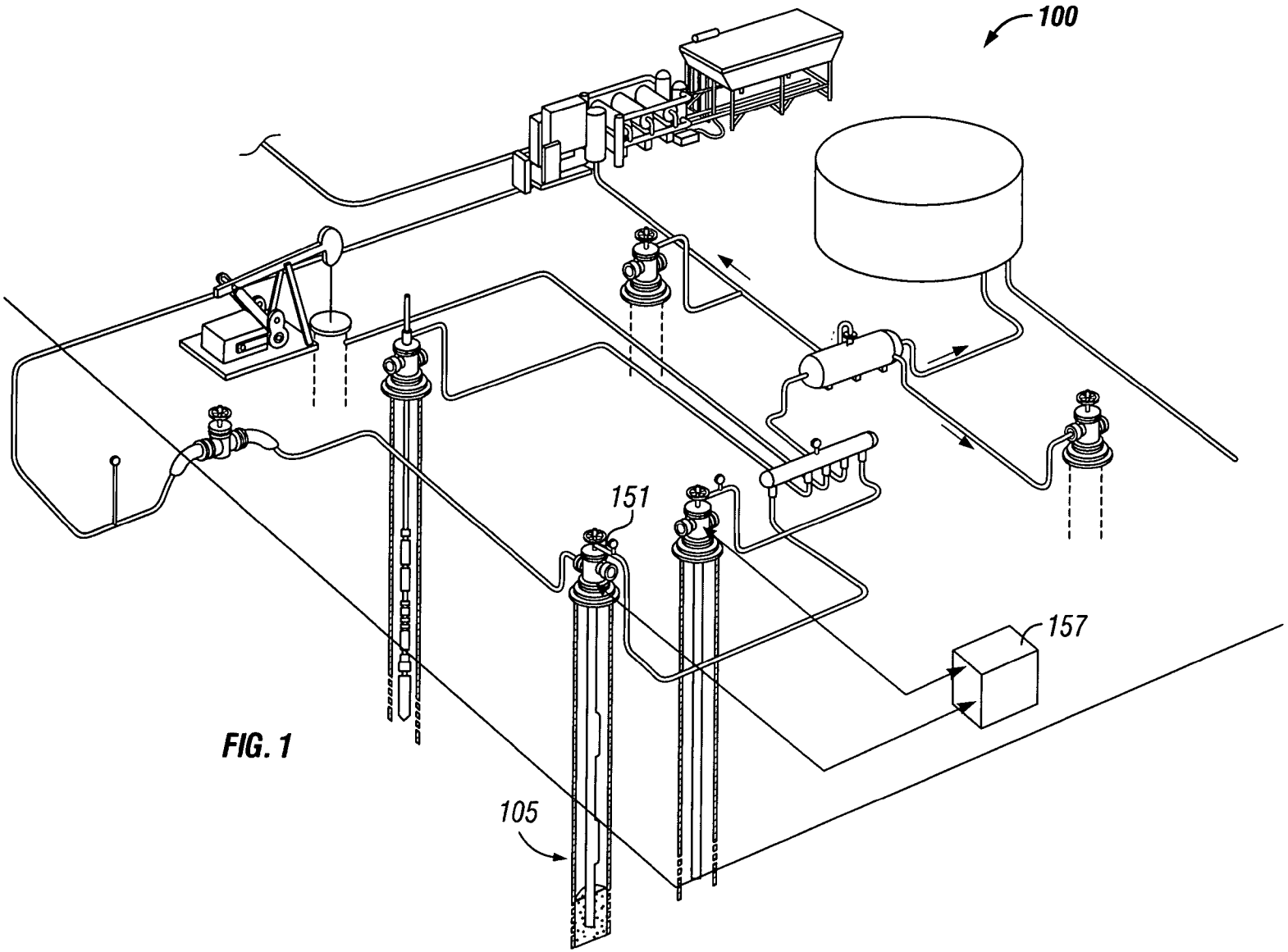
FIG. 1 shows an exemplary oilfield activity having a plurality of wellbores linked to an operations control center.

Aspects of the invention will now be described in detail with reference to the accompanying figures. Like elements in the various figures are denoted by like reference numerals for consistency.

In the following detailed description of aspects of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In general, aspects of the invention provide a method and apparatus to analyze and characterize a well used for extracting hydrocarbons from a reservoir. More specifically, aspects of the invention provide a method and apparatus to analyze and characterize a hydraulically fractured well with multiple reservoir zones (i.e., a multistage hydraulically fractured well) along the well. Each of the reservoirs zones and hydraulic fracture stages that contribute to the commingled production of the well may be characterized using a set of model parameters, including reservoir permeability, fracture half-length, fracture conductivity, and drainage area. The characterization is performed using Bayes's theorem followed by an optimization of the resulting posterior distribution. Bayes's theorem includes conditioning prior static information with the dynamic information, both of which are represented as probability distribution functions.

The characterization may be performed on each fracture stage of the well. The results of the characterization may be used in evaluating the success of a fracture treatment, in selecting restimulation candidates, in optimizing future fracture treatments, in forecasting future performance, and in estimating reserves. A re-stimulation candidate is a wellbore that is suspected to produce more hydrocarbons after repeating the fracturing job using an enhanced procedure. Aspects of the invention may be implemented as oilfield applications in an operations control center.

Turning to FIG. 1, an oilfield activity (100) is depicted including machinery used to extract hydrocarbons, such as oil and gas, from down-hole formations. An operations control center (157) may assist in collecting data and making decisions to enhance operations in the oilfield. Data may include, for example, measurements of gas flow rate and tubing head pressure from oilfield machinery, such as a wellhead tubing and casing (151) for an associated wellbore (105).

Figure 2:
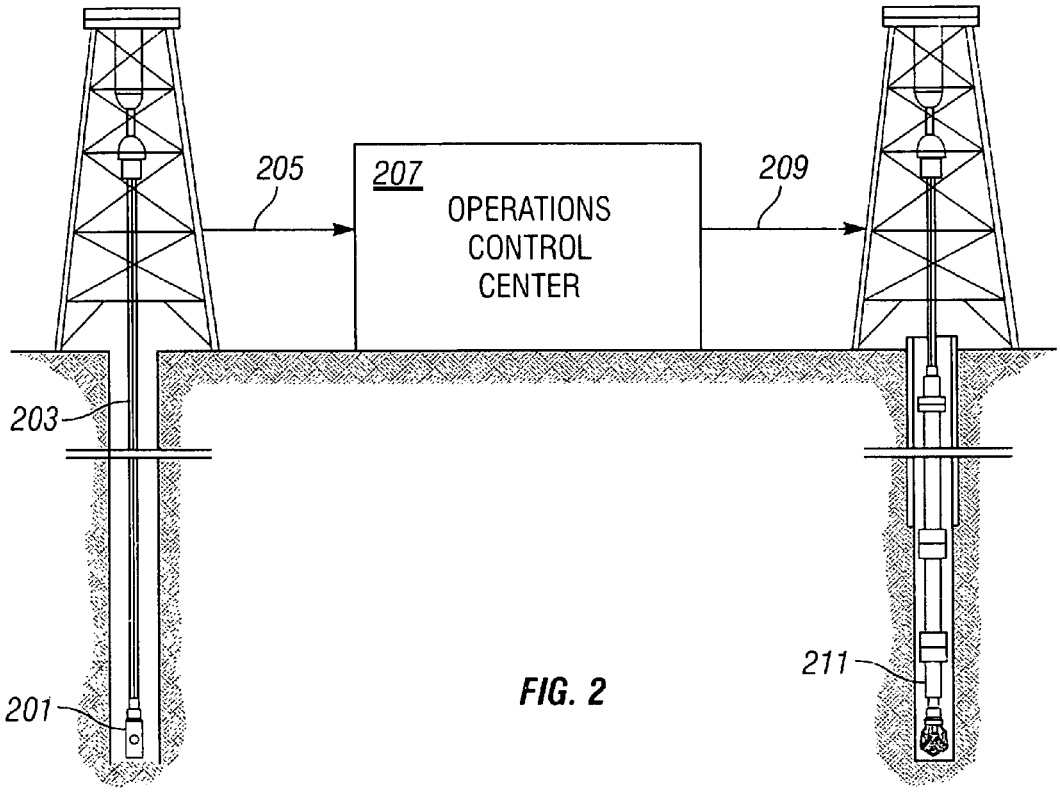
FIG. 2 shows two wellbores in communication with the operations control center of FIG. 1.

FIG. 2 shows a portion of the wellbore operation, such as the wellbore operation of FIG. 1, in detail. This diagram depicts the cooperation of the operations control center (207) with at least two wells. As discussed above, a purpose of the operations control center (207) is to collect data and control a drilling operation. The down-hole sensors (201) and well-head sensors (203) provide data (i.e., data collected and/or otherwise obtained from the down-hole sensors (201) and/or the well-head sensors (203)). Upon receipt of the information, a first communication link (205) transfers the aforementioned data to the operations control center (207).

The operations control center (207) stores and, in some cases, optionally processes and/or analyzes the data. In some cases, the operations control center (207) may also generate and transmit control signals via the second communication link (209) to a down-hole apparatus (211). For example, the operations control center (207) may automatically generate control signals using data obtained via communications link (205). In another example, the operations control center (207) may provide information to an operator that may consider the information, and then send control signals as desired. In addition, in some aspects of the invention, the operations control center (207) may also provide feedback to down-hole sensors (201) and/or well-head sensors (203) using data obtained via communications link (205).

Figure 3:
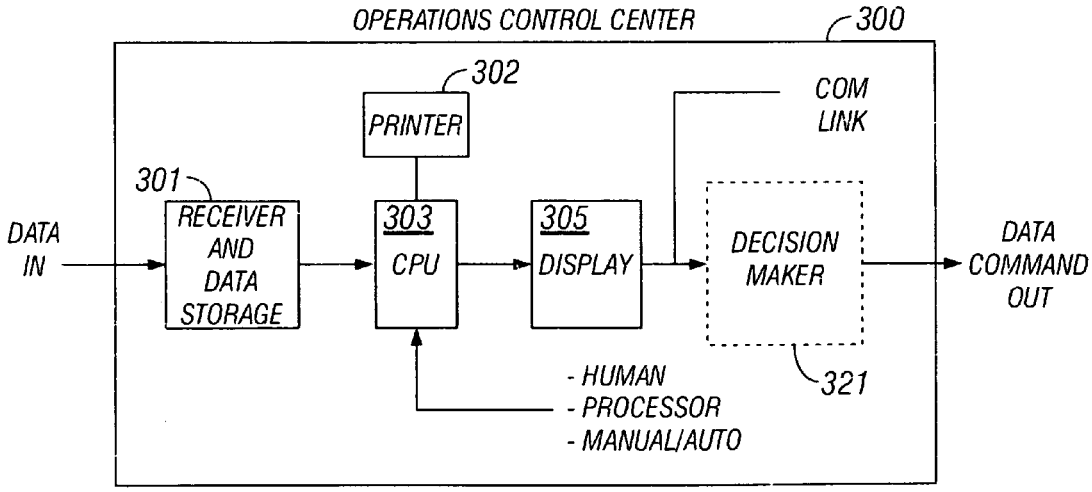
FIG. 3 shows a detailed view of the operations control center of FIG. 2.

FIG. 3 shows an operations control center (300) that may be used with the oilfield operations of FIGS. 1 and 2. A receiver and data storage (301) corresponds to a device configured to receive and store data, for example, from a sensor (i.e., (201, 203) of FIG. 2) or other components internal and/or external to the operations control center (300). Receiver and data storage (301) may be implemented, for example, using a magnetic storage device, an optical storage device, a NAND storage device, any combination thereof, etc.

A CPU (303) (e.g., a microprocessor) is configured to process data (e.g., data stored in the receiver and data storage (301)), to store processed data and/or generate commands to operate various oilfield components shown in FIGS. 1 and 2. In addition, the CPU (303) may operate output devices such as a printer (302), for example, to print out a questionnaire for collecting opinions. The CPU (303) may also operate a display device (305) (e.g., a monitor, etc). A decision-maker (321) may optionally contribute to selecting a work element for enhancing. For example, the decision-maker (321) may operate a keyboard or mouse (not shown) to register estimates (discussed below). The CPU (303) may also store such estimates or rated elements (discussed below) to the receiver and data storage (301).

Figure 4:
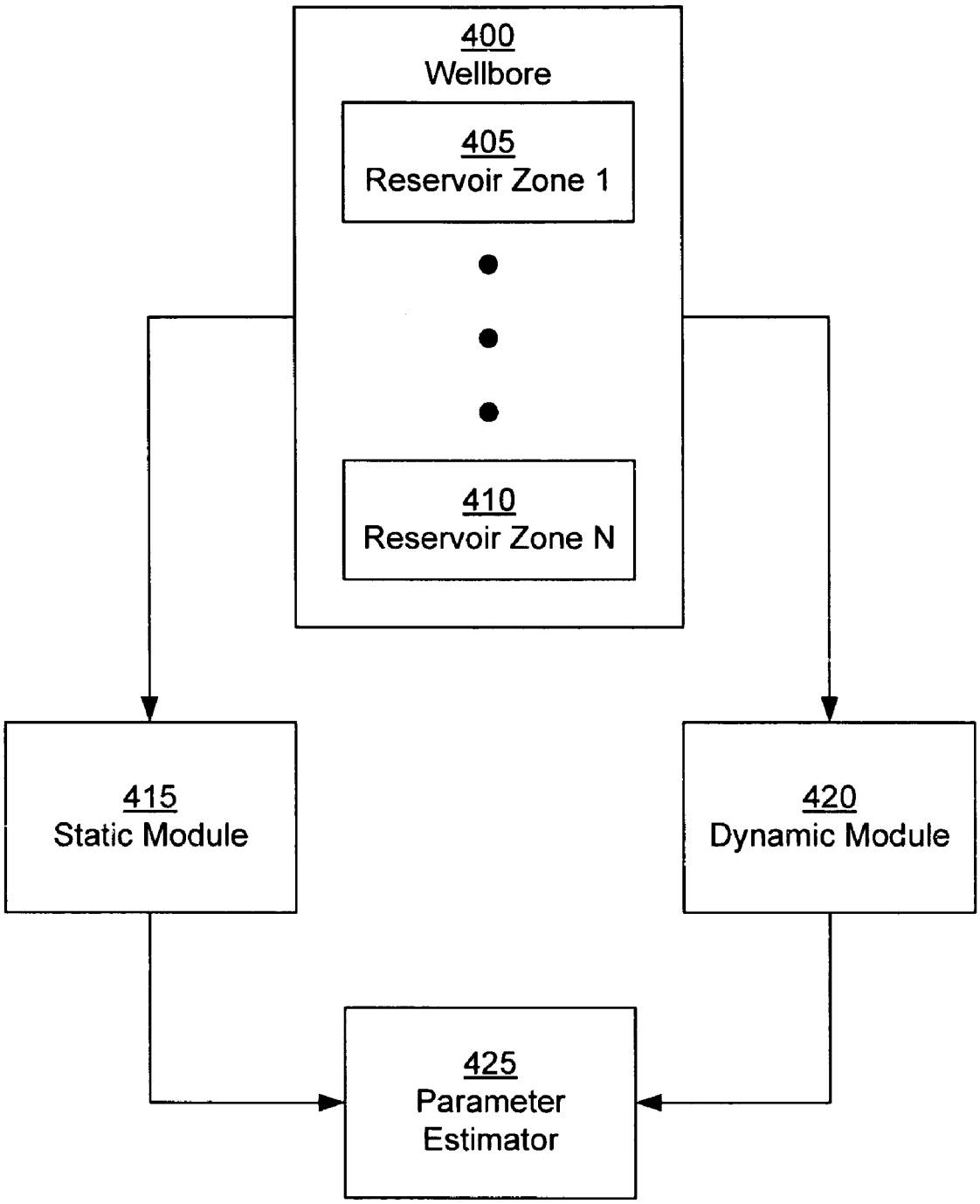
FIG. 4 shows a schematic diagram of a system in accordance with aspects of the invention.

FIG. 4 shows a schematic diagram of a system in accordance with aspects of the invention. The system of FIG. 4 may be implemented using various aspects and functionalities of the operations control center of FIG. 3. For example, the data may be collected by the operations control center or may use the operations control center to perform calculations and/or determine estimates. Further, the system of FIG. 4 may be implemented as one or more oilfield applications running on the operations control center of FIG. 3. As shown in FIG. 4, the system includes a wellbore (400), a static module (415), a dynamic module (420), and a parameter estimator (425).

The wellbore (400) is the physical hole that makes up a well, and can be cased, open or a combination of both. For example, the wellbore (400) may correspond to the openings of the wells in FIGS. 1 and 2. In addition, the wellbore (400) may also refer to the rock face that bounds the drilled hole. The wellbore (400) may be drilled through rock with low permeability. In order to increase hydrocarbon flow, fractures may be hydraulically induced into the reservoir rock (400). Such action permits increased hydrocarbon flow by increasing the surface area of the rock that is exposed to the wellbore. An aspect of the invention, fractures are made in the wellbore (400) by injecting a fluid at a pressure that is higher than the fracturing pressure of the rock. Once the rock has cracked, a proppant, such as sand or sintered bauxite, may be introduced into the crack to keep the fracture open and to allow hydrocarbons, such as oil or natural gas, to flow from the fracture into the wellbore.

As shown in FIG. 4, the wellbore (400) also includes multiple reservoir zones (e.g., reservoir zone 1 (405) and reservoir zone n (410)). In aspects of the invention, a group of discreet reservoir intervals across a hydraulic fracture stage are modeled as a reservoir zone (e.g., reservoir zone 1 (405) and reservoir zone n (410)). For example, the wellbore (400)

may have up to 20 reservoir zones (e.g., reservoir zone 1 (405) and reservoir zone n (410)) along its depth.

In aspects of the invention, a hydraulically fractured wellbore, such as wellbore (400), is characterized to evaluate the success of the fracture treatment, calculate an optimum recovery of the fractured wellbore, select re-stimulation candidates, optimize future fracture treatments of the fractured wellbore, forecast future performance of the fractured wellbore, and/or estimate reserves of the fractured wellbore. The objective of these activities is to make more intelligent decisions that ultimately lead to an increased return on investment and potentially improved production. The objective is often met by making alterations in the well completion of the fractured wellbore, such as a stimulation treatment.

In order to characterize the wellbore (400), the system of FIG. 4 is a schematic of the types of data used in the analysis. It includes a static module (415), a dynamic module (420), and a parameter estimator (425). The static module (415) may handle static data from the wellbore (400), and the dynamic module (420) may handle production data from the wellbore (400). Production data (also sometimes referred to as dynamic data) from the wellbore (400) include the production history of the wellbore (400). The production history includes data such as the commingled flow rates and the tubing head pressures. Production data from the wellbore (400) also include one or more production logs of the wellbore (400). A production log is a record of the relative contribution of each reservoir zone in the wellbore (400) to the commingled flow rate at a particular moment in time. Measurements recorded in a production log may include flow measurements, pressure measurements, temperature measurements, and fluid density measurements. An operations control center may make a set of measurements for a production log at each reservoir zone (e.g., reservoir zone 1 (405), reservoir zone n (410)) of the wellbore (400). Static data include data such as petrophysical information, PVT data, and hydraulic fracture design information.

In addition to receiving input data from the wellbore (400), the static module (415) and dynamic module (420) may perform processing on the data before sending the data to the parameter estimator (425). For example, an operations control center may process the data by generating charts and graphs of the data, applying one or more statistical methods to identify patterns or trends in the data calculating tables of the real gas pseudo-pressure, generating statistical distributions from the data, modeling fluid flow based on one or more flow models, etc. Once the data is obtained and/or processed by the static module (415) and dynamic module (420), the data are passed to the parameter estimator (425). The static module (415), dynamic module (420), and parameter estimator (425) are implemented as one or more oilfield applications in the operations control center of FIG. 3.

The estimator (425) may characterize the wellbore (400) using the data obtained from the static module (415) and dynamic module (420). The parameter estimator (425) may characterize the wellbore (400) using four sets of model parameters: reservoir permeability, fracture half-length, fracture conductivity, and drainage area. Each set corresponds to a reservoir zone. Reservoir permeability is the ability of the fluid-bearing porous rock to transmit fluid. Fracture half-length is the radial distance from the wellbore (400) to the outer tip of a vertical fracture. Fracture conductivity is the product of the fracture permeability and the propped fracture width. Drainage area is the reservoir area drained by the wellbore (400) under stabilized conditions.

An operations control center may characterize the wellbore (400) by calculating the most probable set of model parameters for each reservoir zone (e.g., reservoir zone 1 (405), and reservoir zone n (410)) in the wellbore (400). The parameter estimator (425) may calculate the most probable model parameters for each reservoir zone (e.g., reservoir zone 1 (405), reservoir zone n (410)) in the wellbore (400) by optimization of the posterior distribution resulting from Bayes's theorem. In general terms, Bayes's theorem uses evidence or observations to update the probability that a hypothesis may be true. In this particular application, Bayes's theorem is used to integrate prior static information, i.e., prior knowledge of the reservoir/fracture parameters, including permeability from petrophysical correlations, drainage area from geological information, and fracture geometry and conductivity from the fracture design information to the production data. The operations control center optimizes the posterior distribution obtained as result of Bayes's theorem. In aspects of the invention, optimization of the posterior distribution in Bayes's theorem is referred to as the maximum a posteriori estimation method. Model parameter calculation using Bayes's theorem is explained in detail in FIG. 6.

Figure 5:
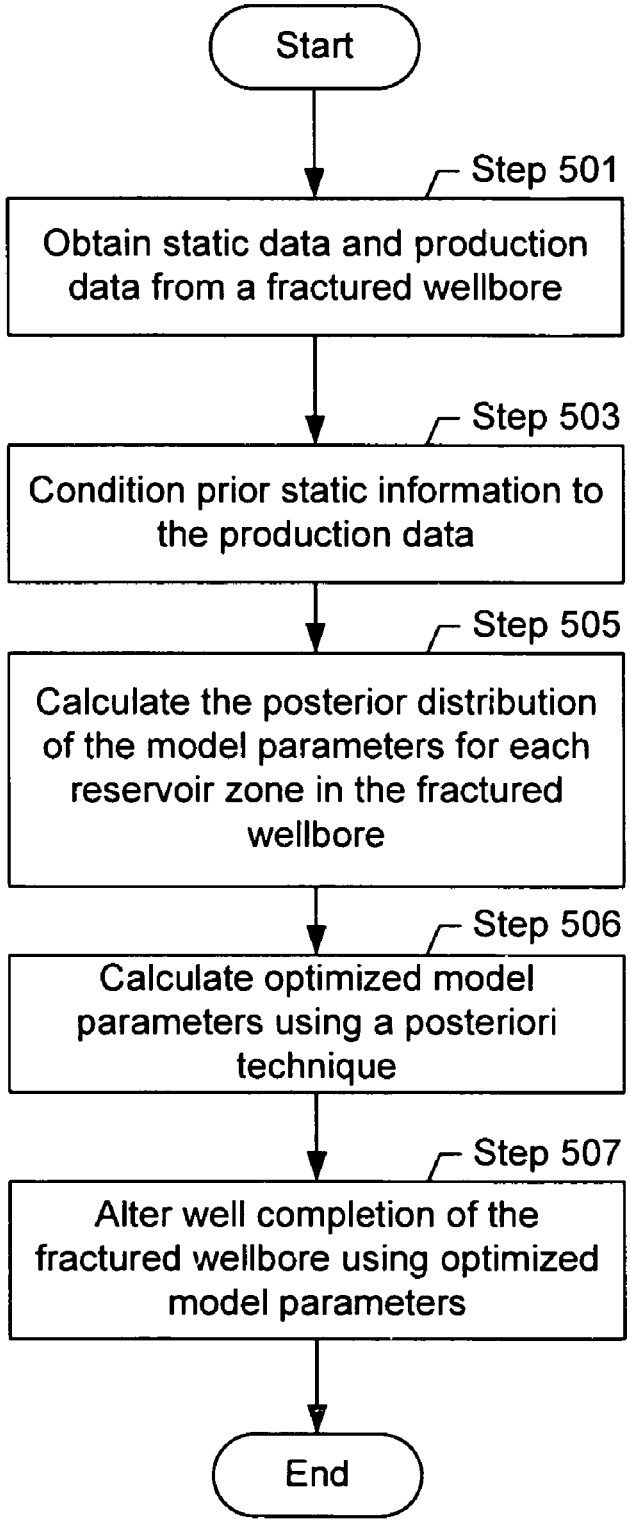
FIGS. 5-6 show flow diagrams in accordance with aspects of the invention.

FIG. 5 shows a flow diagram of wellbore characterization in accordance with aspects of the invention. In aspects of the invention, one or more of the steps described below may be omitted, repeated, and/or performed in a different order. Accordingly, the specific arrangement of steps shown in FIG. 5 should not be construed as limiting the scope of the invention.

Initially, static data and production data are obtained from a fractured wellbore (Step 501). As discussed above, production data may include the wellbore's commingled production history, as well as one or more production logs of the wellbore. In aspects of the invention, the reservoir/fracture parameters are related to the well's performance via a flow model. The flow model is derived by desuperposition of a solution for a well stimulated with a finite-conductivity vertical fracture in an infinite reservoir with a solution for a well stimulated with an infinite conductivity vertical fracture in a bounded cylindrical reservoir.

Bayes's theorem is used to condition prior static information to the production data (Step 503). As discussed in FIG. 1, the posterior distribution of the model parameters may be calculated for each reservoir zone in the fractured wellbore (Step 505). Next, the optimized set of model parameters may be calculated using the maximum a posteriori technique (Step 506). In other words, each of the conditioned model parameters may be modeled as a conditional distribution function. The mode of the conditional distribution function is then used as the most probable value of the corresponding model parameter.

As mentioned above, well completion of the fractured wellbore is altered using the optimized model parameters (Step 507). In other words, knowledge of the model parameters that describe each reservoir zone allows a more intelligent decision-making process to alter the well completion, which leads to the ultimate objective of maximizing the return-on-investment of any project.

Specifically, such alterations may include well stimulation, a change or increase in proppant, etc., which are made based on knowledge of various factors. Factors may include the success of the fracture treatment, selection of re-stimulation candidates, optimization of future fracture treatments in other wellbores, forecasts of future performance of the wellbore, and/or estimation of the reserves of the wellbore. For example, if a group of wells is producing less than expected, it may be desirable to examine whether this is due to a low fracture conductivity caused by use of a proppant that crushes due to excessively high in-situ stresses. If so, it may be desirable to examine what would be the incremental production, and revenue, of using a stronger (and more expensive) proppant that gives a higher fracture conductivity. On the other hand, it may be desirable to know whether the low productivity is due to a low reservoir permeability or a short fracture. In addition, the set of parameters that satisfactorily match the commingled production and the production logs may be used to forecast the wellbore's future performance by extrapolation in time.

Figure 6:
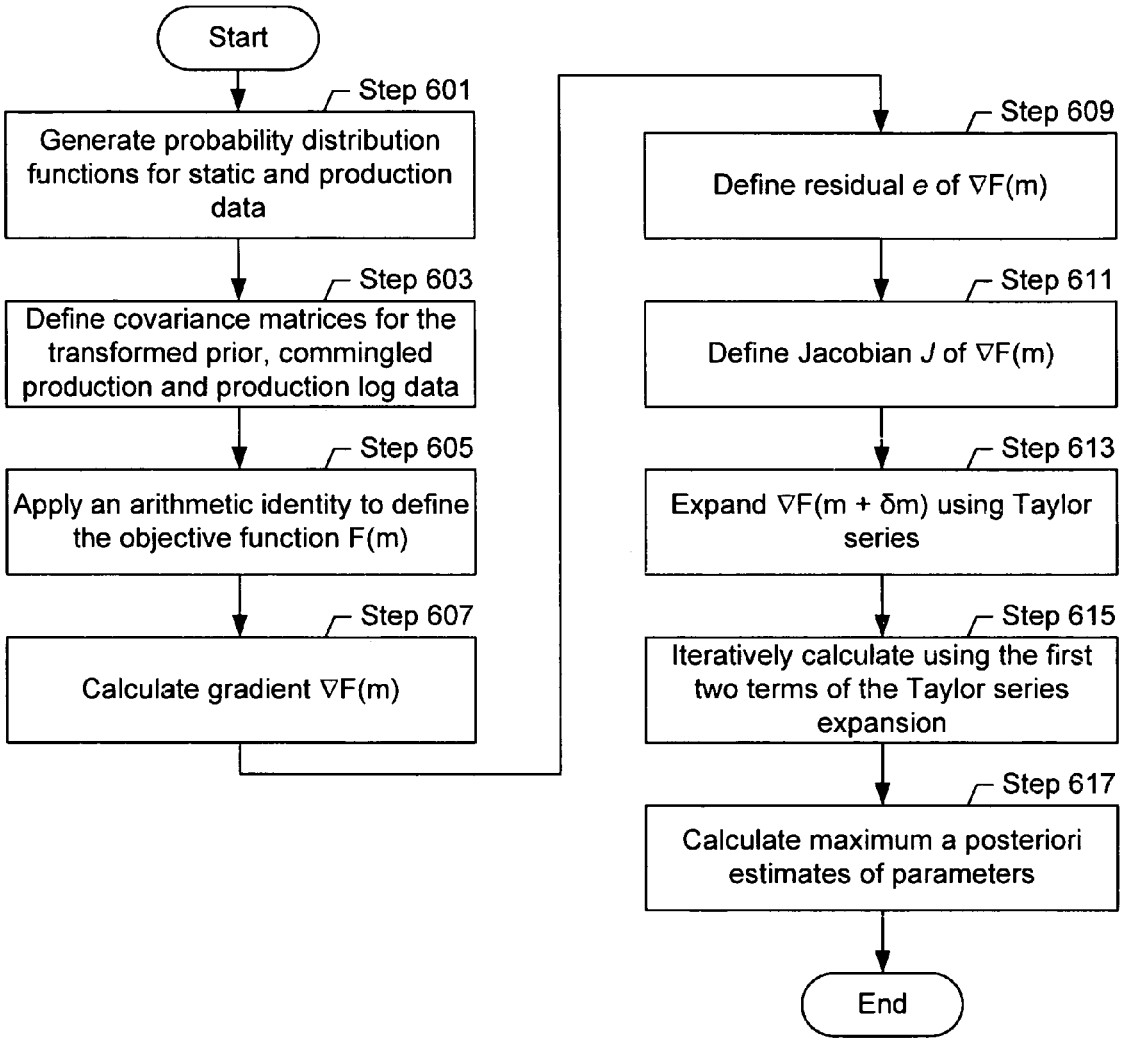

FIG. 6 shows a flow diagram of model parameter calculation in accordance with aspects of the invention. In aspects of the invention, one or more of the steps described below may be omitted, repeated, and/or performed in a different order. Accordingly, the specific arrangement of steps shown in FIG. 6 should not be construed as limiting the scope of the invention.

Initially, probability distribution functions (pdfs) are generated for the static data and production data (Step 601). In aspects of the invention, Bayes's Theorem is used as the basis for the pdfs. In addition, Bayes's theorem is used to condition the prior information to production information. As mentioned above, the prior information may include petrophysical information, geological information, and fracture design information. In mathematical terms, Bayes's theorem states that:

$$P(m \mid d, d_{PL}) = \frac{P(m)P(d, d_{PL} \mid m)}{P(d, d_{PL})}$$

In this equation, m represents a vector with prior information about the model parameters, d represents a vector containing the commingled production history of the wellbore, and $d_{PL}$ represents a vector containing production log information. $P(m|d, d_{PL})$ is the conditional pdf of the model parameters given the production data. This conditional pdf of the model parameters is called the posterior distribution. P(m) represents the prior pdf of the model parameters before the model parameters have been conditioned to production data. $P(d, d_{PL}|m)$ represents the conditional pdf of d and $d_{pL}$ given m. This conditional pdf is called the likelihood function. Using properties of joint distributions, the equation above may be converted into the following form:

$$P(m \mid d, d_{PL}) = \frac{P(d_{PL} \mid d, m)}{P(d_{PL} \mid d)} \cdot \frac{P(d \mid m)P(m)}{P(d)}$$

Those skilled in the art will appreciate that the denominator of the conditional pdf does not depend on m. As a result, calculating the values of the model parameters depends only on the numerator terms of the conditional pdf, or P(m), $P(d_{PL}|d, m)$, and P(d|m).

In aspects of the invention, pdfs for the numerator terms of the conditional pdf may be transformed into normal (Gaussian) distributions using normal score transforms. Once transformed into Gaussian distributions, covariance matrices are defined for the transformed prior, commingled production and production log data (Step 603). In aspects of the invention, the covariance matrix contains information about the spatial correlation and uncertainty of the parameters and the data.

Upon transformation to a normal score transform, the pdf for the prior distribution may be represented using the following Gaussian distribution:

$$P(m) = \frac{1}{(2\pi)^{(4M)/2}|C_M|^{1/2}} \exp\left\{-\frac{1}{2}(m - m_p)^T C_M^{-1}(m - m_p)\right\}$$

In the above equation, M represents the number of reservoir zones, $m_p$ represents the normal score transform of the prior knowledge of the parameters, and m represents the normal score transform of the unknown parameters in the posterior distribution. In addition, $C_M$ denotes the covariance matrix of the normal score transform of the prior model parameters. In one aspect of the invention, $C_M$ may be calculated using a variogram of the model parameters.

Similarly, the pdf for $P(d_{PL}|d, m)$ may be represented using the following Gaussian distribution:

$$P(d_{PL} \mid d, m) = \frac{1}{(2\pi)^{N_{PL}/2}|C_{PL}|^{1/2}} \exp\left\{-\frac{1}{2}[d_{PL} - g_{PL}(m, d)]^T C_{PL}^{-1}[d_{PL} - g_{PL}(m)]\right\}$$

In other words, the production log data may be modeled as a Gaussian distribution, where $N_{PL}$ indicates the number of production logs, $C_{PL}$ represents the covariance matrix of the production logs, and $g_{PL}(m)$ is the calculated flow rate from each reservoir zone at the time of the production logs calculated using a flow model. In aspects of the invention, noise in the production log data is modeled using the covariance matrix $C_{PL}$. In aspects of the invention, because noise in the production log data is not time-dependent, $C_{PL}$ . is a diagonal matrix with the diagonal values equal to the variance for a particular production log.

Upon transformation of the commingled production data to a Gaussian distribution via a normal score transform.

$$P(d \mid m) = \frac{1}{(2\pi)^{N/2}|C_d|^{1/2}} \exp\left\{-\frac{1}{2}[d - g(m)]^T C_d^{-1}[d - g(m)]\right\}$$

Similar to the terms in the Gaussian for the production log data, N represents the number of data points in the production history, $C_d$ signifies the covariance matrix of the commingled production history data, and g(m) denotes the model of the commingled production history data calculated using a flow model. As with the production log data, the covariance matrix $C_d$ represents noise in the production history data. It is also a diagonal matrix with the diagonal elements equal to the variance at a particular time.

In aspects of the invention, the pdf of the model parameters conditioned to production data are calculated from the left-hand side of Bayes's theorem. Whereupon, the model parameters are calculated as the mode of the posterior pdf, $P(m|d, d_{PL})$. Substituting the equations found in paragraphs [0043], [0044], and [0045] into the equation shown in paragraph [0041] yields:

$$P(m|d, d_{PL}) \propto \exp[-F(m)].$$

In aspects of the invention, F(m) represents the objective function to be optimized in the maximum a posteriori technique. Specifically, F(m) results from application of a simple arithmetic identity, i.e. the product of exponentials results in a term with an exponent equal to the sum of each individual exponent (Step 605). Thus, $$2F(m)=[d-g(m)]^T C_d^{-1}[d-g(m)]+[d_{PL}-g_{PL}(m)]^T C_{PL}^{-1}[d_{PL}-g_{PL}(m)]+(m-m_p)^T C_M^{-1}(m-m_p)$$

In aspects of the invention, the terms in the above equation are referred to as the data misfit, production log misfit, and prior knowledge, respectively.

In aspects of the invention, the mode of the posterior pdf, $P(m|d, d_{PL})$, may be calculated as the maximum value of the posterior pdf. Those skilled in the art will appreciate that the maximum value of the posterior pdf is equivalent to the minimum value of F(m), which may be found by calculating the roots of the gradient of F(m). As a result, the optimum set of model parameters calculated using the maximum a posteriori technique may be obtained by solving the following equation for m:

$$\nabla F(m)=\Theta$$

∇F(m) represents the gradient of F(m) in the 4M-dimensional domain of m, which is calculated (Step 607) below. In addition, Θ represents a zero vector of the same size as m. In aspects of the invention, both ∇F(m) and Θ are vectors in the 4M-dimensional domain of m. In other words, the four sets of model parameters are calculated for each of the M fracture zones of the wellbore, thus yielding 4M components.

To simplify the notation of the gradient, ∇F(m), the residual e (Step 609) and Jacobian J (Step 611) are defined. In aspects of the invention, the residual e represents an estimate of the error between the observed data and parameters and the expected values of the data and the parameters. In aspects of the invention, the expected values of the data are estimated using a flow model, as described above. The residual e may be calculated using the following equation:

$$e=\begin{bmatrix} C_{PL}^{-1/2}(d_{PL}-g_{PL}) \\ C_d^{-1/2}(d-g) \\ C_M^{-1/2}(m_p-m) \end{bmatrix}$$

In aspects of the invention, the objective function F(m) can be simplified in terms of the residual as:

$$F(m)=\frac{1}{2}e^T e$$

Similarly, the Jacobian J may be defined as the gradient of the residual:

$$J=\nabla e$$

In aspects of the invention, the roots of the gradient ∇F(m) may be approximated by expanding the gradient around m+δm using a Taylor series (Step 613):

$$\nabla F(m+\delta m)=\nabla F(m)+\nabla(\nabla F(m))\delta m+$$

In aspects of the invention, the roots of the gradient may be calculated iteratively using the first two terms of the Taylor series expansion (Step 615) as:

$$q+H\delta m=\Theta$$

In the above equation, q represents the gradient, ∇F(m), and H represents the Hessian matrix of the objective function, F(m). Thus, $$H=\nabla[\nabla(F(m))]$$

In aspects of the invention, the Jacobian J is expressed in terms of the prior information and production data:

$$J=-\begin{bmatrix} C_{PL}^{-1/2}G_{PL} \\ C_d^{-1/2}G_d \\ C_M^{-1/2} \end{bmatrix}$$

In aspects of the invention, $G_{PL}$ and $G_d$ represent the sensitivities of the production log data and the commingled production data to each of the model parameters, respectively. In aspects of the invention, $G_{PL}$ and $G_d$ are calculated as the gradients of $g_{PL}$ and g, respectively. In addition, the Hessian H may be approximated using the following series of equations:

$$q=J^T e$$

$$H=\nabla q=\nabla(J^T e)$$

$$H=(\nabla J^T)e+J^T J$$

Those skilled in the art will appreciate that in quasi-linear problems, the first term in the last equation is negligible compared to the second term. As a result, H may be approximated using the second term only. Thus, $$H\cong J^T J$$

Using the above equations, the problem of calculating the roots of the gradient may be reduced to a mean-square problem. Thus $$J^T J\delta m=-J^T e$$

It may be further simplified to: Jδm=−e.

As a result, the optimized set of reservoir/fracture parameters (e.g., maximum a posteriori estimates) conditioned to production data may be determined iteratively from:

$$\begin{bmatrix} C_{PL}^{-1/2}G_{PL} \\ C_d^{-1/2}G_d \\ C_M^{-1/2} \end{bmatrix}\delta m=\begin{bmatrix} C_{PL}^{-1/2}(d_{PL}-g_{PL}) \\ C_d^{-1/2}(d-g) \\ C_M^{-1/2}(m_p-m) \end{bmatrix}$$

The iterative procedure is repeated until a desired tolerance is achieved (Step 617).

Figure 7:
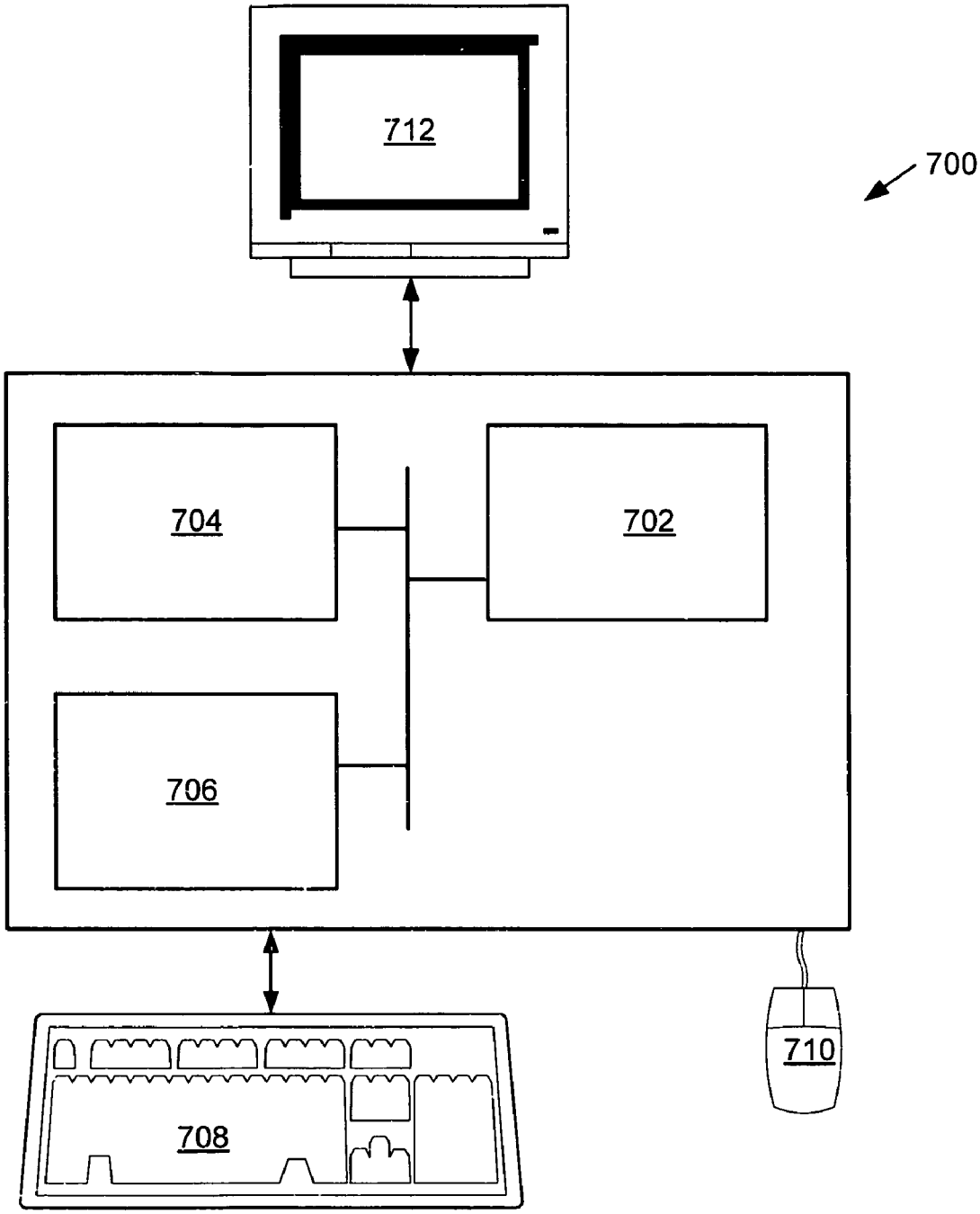
FIG. 7 shows a computer system in accordance with aspects of the invention.

The invention is currently implemented using Microsoft® Visual Basic for Applications (VBA) in Microsoft® Excel. However, the invention may be implemented on virtually any type of computer regardless of the platform being used. For example, as shown in FIG. 7, a computer system (700) includes a processor (702), associated memory (704), a storage device (706), and numerous other elements and functionalities typical of today's computers (not shown). The computer (700) may also include input means, such as a keyboard (708) and a mouse (710), and output means, such as a monitor (712). The computer system (700) is connected to a local area network (LAN) or a wide area network (e.g., the Internet) (not shown) via a network interface connection (not shown). Those skilled in the art will appreciate that these input and output means may take other forms.

Further, those skilled in the art will appreciate that one or more elements of the aforementioned computer system (700) may be located at a remote location and connected to the other elements over a network. Further, the invention may be implemented on a distributed system having a plurality of nodes, where each portion of the invention (e.g., static module, dynamic module, parameter estimator, etc.) may be located on a different node within the distributed system. In one aspect of the invention, the node corresponds to a computer system. Alternatively, the node may correspond to a processor with associated physical memory. The node may alternatively correspond to a processor with shared memory and/or resources. Further, software instructions to perform aspects of the invention may be stored on a computer system such as a compact disc (CD), a diskette, a tape, a file, or any other computer readable storage device.

While the invention has been described with respect to a limited number of aspects, those skilled in the art, having benefit of this disclosure, will appreciate that other aspects can be devised which do not depart from the scope of the invention as disclosed herein. Accordingly, the scope of the invention should be limited only by the attached claims.

What is claimed is:

1. A method for characterizing a fractured wellbore comprising a plurality of reservoir zones, comprising:

obtaining static data and production data from the plurality of reservoir zones;

integrating the static data and the production data using Bayes' theorem;

calculating a plurality of probability-based model parameters for each of the plurality of reservoir zones using Bayes' theorem;

iteratively optimizing the plurality of probability-based model parameters using an objective function, $J\delta m=-e$, wherein:

J is a Jacobian based on the static data, the production data, and the plurality of probability-based model parameters, e is an estimate of error between observed values and expected values of the static data, the production data, and the plurality of probability-based model parameters, and $\delta m$ is a change in a normal score transform of the plurality of probability-based parameters in a posterior distribution; and altering completion of the fractured wellbore using the plurality of probability-based model parameters.

2. The method of claim 1, further comprising:

generating a plurality of probability distribution functions (pdfs) from the plurality of probability-based model parameters, the static data, and the production data; and calculating the objective function using the plurality of pdfs; and enhancing the objective function.

3. The method of claim 2, wherein the objective function is enhanced using a maximum a posteriori estimation technique.

4. The method of claim 2, wherein the plurality of pdfs is generated using the normal score transform.

5. The method of claim 1, wherein the plurality of probability-based model parameters is used to alter the well completion by performing at least one selected from a group consisting of evaluating a fracture treatment of the fractured wellbore, selecting a re-stimulation candidate, enhancing a fracture treatment of the fractured wellbore, forecasting performance of the fractured wellbore, and estimating reserves of the fractured wellbore.

6. The method of claim 1, wherein the plurality of probability-based model parameters comprise a reservoir permeability, a fracture half-length, a fracture conductivity, and a drainage area for each reservoir zone.

7. The method of claim 1, wherein the production data comprises a tubing head pressure, a well production rate, and a production log.

8. The method of claim 7, wherein the production log comprises a flow measurement, a pressure measurement, a temperature measurement, and a fluid density measurement at the plurality of reservoir zones of the fractured wellbore.

9. A system for characterizing a fractured wellbore comprising a plurality of reservoir zones, comprising:

a static module, wherein the static analysis module is configured to obtain static data from the plurality of reservoir zones;

a dynamic module, wherein the dynamic analysis module is configured to obtain production data from the plurality of reservoir zones; and a parameter estimator configured to:

integrate the static and production data using Bayes' theorem;

calculate a plurality of probability-based model parameters for each of plurality of reservoir zones using Bayes' theorem;

iteratively optimize the plurality of probability-based model parameters using an objective function, $J\delta m=-e$, wherein:

J is a Jacobian based on the static data, the production data, and the plurality of probability-based model parameters, e is an estimate of error between observed values and expected values of the static data, the production data, and the plurality of probability-based model parameters, and $\delta m$ is a change in a normal score transform of the plurality of probability-based parameters in a posterior distribution; and alter completion of the fractured wellbore using the plurality of probability-based model parameters.

10. The system of claim 9, wherein the parameter estimator is further configured to:

generate a plurality of probability distribution functions (pdfs) from the plurality of probability-based model parameters, the static data, and the production data; and calculate the objective function using the plurality of pdfs; and enhance the objective function.

11. The system of claim 10, wherein the objective function is enhanced using a maximum a posteriori estimation technique.

12. The system of claim 11, wherein the static module calculates a model prediction of the static data, and wherein the dynamic module calculates a model prediction of the production data.

13. The system of claim 10, wherein the plurality of pdfs is generated using the normal score transform.

14. The system of claim 9, wherein the plurality of probability-based model parameters is used to perform at least one selected from a group consisting of evaluating a fracture treatment of the fractured wellbore, selecting a re-stimulation candidate, enhancing a fracture treatment of the fractured wellbore, forecasting performance of the fractured wellbore, and estimating reserves of the fractured wellbore.

15. The system of claim 9, wherein the plurality of probability-based model parameters comprise a reservoir permeability, a fracture half length, a fracture conductivity, and a drainage area for each reservoir zone.

16. The system of claim 9, wherein the production data comprises a tubing head pressure, a well production rate, and a production log.

17. The system of claim 16, wherein the production log comprises a flow measurement, a pressure measurement, a temperature measurement, and a fluid density measurement at a plurality of fracture zones of the fractured wellbore.

18. A computer system for managing an oilfield activity for an oilfield having at least one processing facility and at least one wellsite operatively connected thereto, each at least one wellsite having a fractured wellbore penetrating a subterranean formation for extracting fluid from a plurality of reservoir zones therein, comprising:

a processor;

memory; and software instructions stored in memory to execute on the processor to:

obtain static data and production data from the plurality of reservoir zones;

integrate the static data and the production data using Bayes' theorem;

calculate a plurality of probability-based model parameters for each of the plurality of reservoir zones using Bayes' theorem;

iteratively optimize the plurality of probability-based model parameters using an objective function, $J\delta m=-e$, wherein:

J is a Jacobian based on the static data, the production data, and the plurality of probability-based model parameters, e is an estimate of error between observed values and expected values of the static data, the production data, and the plurality of probability-based model parameters, and $\delta m$ is a change in a normal score transform of the plurality of probability-based parameters in a posterior distribution; and alter completion of the fractured wellbore using the plurality of probability-based model parameters.

19. The computer system of claim 18, further comprising software instructions stored in memory to execute on the processor to:

generate a plurality of probability distribution functions (pdfs) from the plurality of probability-based model parameters, the static data, and the production data; and calculate the objective function using the plurality of pdfs; and enhance the objective function.

20. The computer system of claim 19, wherein the objective function is enhanced using a maximum a posteriori estimation technique.

21. The computer system of claim 19, wherein the plurality of pdfs is generated using the normal score transform.

22. The computer system of claim 18, wherein the plurality of probability-based model parameters is used to alter the well completion by performing at least one selected from a group consisting of evaluating a fracture treatment of the fractured wellbore, selecting a re-stimulation candidate, enhancing a fracture treatment of the fractured wellbore, forecasting performance of the fractured wellbore, and estimating reserves of the fractured wellbore.

23. The computer system of claim 18, wherein the plurality of probability-based model parameters comprise a reservoir permeability, a fracture half-length, a fracture conductivity, and a drainage area for each reservoir zone.

24. The computer system of claim 18, wherein the production data comprises a tubing head pressure, a well production rate, and a production log.

25. The computer system of 24, wherein the production log comprises a flow measurement, a pressure measurement, a temperature measurement, and a fluid density measurement at the plurality of reservoir zones of the fractured wellbore.

* * * * *